US007074476B2

(12) United States Patent
Weaver et al.

(10) Patent No.: US 7,074,476 B2
(45) Date of Patent: Jul. 11, 2006

(54) FLEXIBLE CARRIER HAVING REGIONS OF HIGHER AND LOWER ENERGY TREATMENT

(75) Inventors: William N. Weaver, Northbrook, IL (US); Glenn E. Ihrig, Jr., Libertyville, IL (US); Jason R. Moreau, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/953,133

(22) Filed: Sep. 29, 2004

(65) Prior Publication Data

US 2005/0112322 A1 May 26, 2005

Related U.S. Application Data

(60) Provisional application No. 60/523,558, filed on Nov. 20, 2003.

(51) Int. Cl.
*B32B 3/24* (2006.01)
*B65D 75/42* (2006.01)

(52) U.S. Cl. ..... 428/131; 428/409; 206/145; 206/150; 206/151; 206/158; 206/153; 206/147; 493/326

(58) Field of Classification Search ..... 428/131, 428/409; 206/145, 150, 151, 158, 153, 147; 493/326

See application file for complete search history.

(56) References Cited

U.S. PATENT DOCUMENTS

| | | | | |
|---|---|---|---|---|
| 4,024,038 | A * | 5/1977 | Luc | 204/168 |
| 4,709,808 | A * | 12/1987 | Balduff et al. | 206/158 |
| 4,900,388 | A * | 2/1990 | Wyslotsky | 156/272.6 |
| 5,538,790 | A | 7/1996 | Arvedson et al. | |
| 5,695,050 | A | 12/1997 | Weaver | |
| 5,789,029 | A | 8/1998 | Ramsey et al. | |
| 6,122,893 | A | 9/2000 | Weaver et al. | |
| 6,234,945 | B1 | 5/2001 | Weaver | |
| 6,312,566 | B1 * | 11/2001 | Iwaisaki et al. | 204/165 |
| 6,598,738 | B1 * | 7/2003 | Weaver | 206/150 |

OTHER PUBLICATIONS

*Film Extrusion Manual*, Film Extrusion Committee of the Polymers, Laminations and Coatings Division, Committee Assignment No. 02130.00 (Tappi Press, 1992), excerpts. pp. 372, 373, 386, 387, 388, 389, 392, 393, 401, 400, 399, 398, 397, 394, 395, 396, 618.

Atmospheric silent discharge versus low-pressure plasma treatment of polyethylene, polypropylene, polyisobutylene, and polystyrene, O.D. Greenwood et al., *J. Adhesion Sci. Technol.*, (vol. 9, No. 3, pp. 311-326) (1995).

(Continued)

*Primary Examiner*—William P. Watkins, III
(74) *Attorney, Agent, or Firm*—Pauley Petersen & Erickson

(57) ABSTRACT

A flexible carrier for carrying a plurality of beverage containers includes a plurality of container holders, each having a portion with higher energy treatment and a portion with lower energy treatment. The energy treatment is corona or plasma treatment. The portions with higher energy treatment provide better carrier-to-container friction. By varying the level of energy treatment and the relative size of the portions being treated, the amount of overall friction between the flexible carrier and the containers can be controlled.

27 Claims, 2 Drawing Sheets

OTHER PUBLICATIONS

Surface Changes of Corona-Discharge-Treated Polyethylene Films, Eniko Foldes et al., *Journal of Applied Polymer Science*, (vol. 76, pp. 1529-1541) (2000).
Surface Modification of Low-Density Polyethylene (LDPE) *Film and Improvement of Adhesion Between Evaporated Copper Metal Film and LDPE*, Ju-Shik Kong et al., *Journal of Applied Polymer Science*,(vol. 82, pp. 1677-1690) (2001).
*Corona Discharge*, P. Prentice, Plastics Consultancy Network Poly-Tech Consultants Limited (Mar. 2001) (4 pages).
*Improvement of wettability and reduction of aging effect by plasma treatment of low density polyethylene with argon and oxygen mixtures*, B.K. Kim et al., J. Adhesion Sci. Technol., (vol. 16, No. 5, pp. 509-521 (2002).
*Plasma Processes for Wide Fabric, Non-wovens and Film*, S. Kaplan, Fourth International Symposium on Polymer Surface Modification: Relevance to Adhesion (Jun. 2003).
Croda Universal Ltd., Data Sheets (8 pages), undated. Starting With Slip Performance.
*Corona Treatment 101-Understanding the basics from a narrow web perspective*, B. Stobbe, (3 pages), undated.
*Frequency Effects On Corona Discharge Treatment*, B. Stobbe, Corotec Corporation (4 pages), undated.
*Web Treatment—Going Solventless*, S. Greig, Sherman Treaters Ltd. (22 pages), undated.
Markgraf, D.A., "*Corona Treatment: An Overview*", Enercon Industries Corporation (46 pages).
Maxwell, J.W. et al., "*The Effect Of Time And Contact On Corona Treated Surfaces*" (4 pages).
Decker, W., et al., "*Long Lasting Surface Activation of Polymer Webs", 2000 Society of Vacuum Coaters* 505/856-7188, 43rd Annual Technical Conference Proceedings (2000) ISSN 0737-5921 (6 pages).
Designation: D 1894-01, "*Standard Test Method for Static and Kinetic Coefficients of Friction of Plastic Film and Sheeting*", ASTM International (pp. 1-6).
Designation: D 2578-04a, "*Standard Test Method for Wetting Tension of Polyethylene and Polypropylene Films*", ASTM International (pp. 1-4).

* cited by examiner

FLEXIBLE CARRIER HAVING REGIONS OF HIGHER AND LOWER ENERGY TREATMENT

This application claims the benefit under 35 U.S.C. §119(e) of U.S. Provisional Application 60/523,558, filed on 20 Nov. 2003.

FIELD OF THE INVENTION

This invention is directed to a flexible carrier useful for holding beverage cans and bottles. The flexible carrier has regions of higher and lower energy treatment which provide controlled friction to the containers, making it relatively hard for the containers to slip out of the carrier during transport, merchandising and consumer handling, yet relatively easy for a consumer to remove the containers from the carrier.

BACKGROUND OF THE INVENTION

Flexible carriers are used to carry a wide variety of beverage containers as four-packs, six-packs, eight-packs, ten-packs, twelve-packs and the like. Flexible carriers are carriers which are stretched during application of the carriers to the containers. While the containers can be formed of plastic, metal or glass, the flexible carriers are typically formed of plastic.

One challenge facing the beverage industry has been to achieve a proper balance of friction and slip between the flexible carrier and the filled containers. If the friction is too little, and the slip is too great, then the filled containers may dislodge from the carrier while the multi-container pack is being handled or carried. If the friction is too great, it may be difficult for the consumer to separate the individual containers from the carrier for consumption. Also, machine application of the carrier to the containers becomes more difficult because the gripping jaws of the applicating machine may not release the carrier.

The foregoing challenge is compounded by the incentive to form the flexible carriers from relatively few, inexpensive plastic materials, and the consequent need to adapt these materials to containers of different sizes, shapes, weights and material compositions. The flexible carriers are often formed of polyolefins, such as polyethylene. The containers they carry may vary from a few grams to kilograms in weight; may range from narrow to broad, and short to tall sizes; may be formed of different kinds of plastic, metal or glass; and may have slippery labels or other features that make it difficult to achieve optimal friction between the carrier and the containers.

Efforts have been made to optimize the carrier to container friction in various applications by a) adding varying amounts of slip and other additives which alter the adhesion, and b) varying the amount of tension between the carrier strips and the containers being held. These modifications are sometimes not sufficient to optimize adhesion between the flexible carriers and containers, particularly when the containers are large, heavy and/or have a slippery outer surface.

There is a need or desire for a technology which provides a wider range of possible adjustments to optimize the holding capabilities of flexible carriers.

SUMMARY OF THE INVENTION

The present invention is directed to a flexible carrier useful for beverage containers, including a plurality of container holders, having at least one zone of higher energy treatment and at least one zone of lower energy treatment in the container holder surrounding each container. The phrase "flexible carrier" as used herein, refers to a carrier which flexes and stretches in order to install its container holder portions around the neck, body or chime of each container. The phrase "energy treatment" refers to a surface treatment selected from the group consisting of corona treatment, plasma treatment and combinations thereof. These energy treatments raise the surface energy of a carrier via oxidation, ionization or the like, so as to increase carrier to container friction in the treated region(s). The phrase "lower energy treatment" as used herein, refers to zero corona or plasma treatment, or any level of corona or plasma treatment which is less than the corona or plasma treatment received in the zone of higher energy treatment.

The zones of higher and lower energy treatment can be obtained by selectively corona or plasma treating the zone where higher treatment is desired. The selective treatment causes that zone to experience surface oxidation and/or ionization, resulting in higher carrier to container friction.

The zone of higher energy treatment provides enough friction between the treated parts of the holders and the containers to prevent the containers from dislodging during routine handling and carrying of the multi-container package. The zone of higher energy treatment only extends part of the distance around each container holder. The zone of lower energy treatment extends the remainder of the distance around each container holder. The zone of lower energy treatment provides less friction in order to facilitate removal of the containers by the consumer, as well as carrier production and machine application of the carrier to the containers. In particular, the zone of lower energy treatment provides a lower friction surface for contact with the gripping jaws of an applicator machine which applies the carrier to the containers. One example of an applicator machine is disclosed in U.S. Pat. No. 6,122,893, which is incorporated by reference.

DETAILED DESCRIPTION OF THE PRESENTLY PREFERRED EMBODIMENTS

Figure 1:
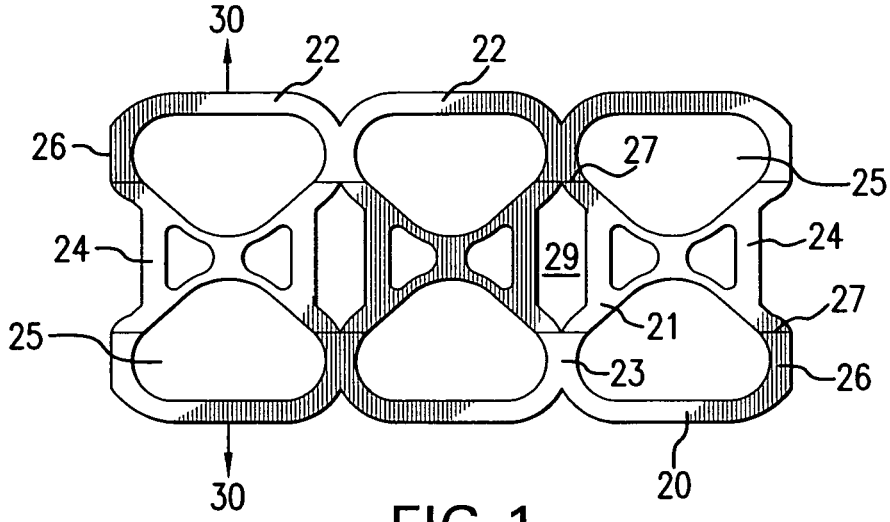
FIG. 1 illustrates one flexible carrier of the invention, having a zone of higher energy treatment and two zones of lower energy treatment.

Referring to FIG. 1, a flexible carrier 20 includes a flexible sheet having a plurality of container holders 22 formed therein, each defining a primary opening 25 for receiving a container. The flexible carrier 20 is formed of a plastic material, suitably a polyolefin as described below. The flexible carrier 20 has an inner zone 24 of relatively higher energy treatment, and two outer zones 26 of relatively lower energy treatment. Outer zones 26 may receive at least 25% less energy treatment, suitably at least 50% less, desirably at least 75% less energy treatment than inner zone 26, and preferably receive no energy treatment. The energy treatment is suitably corona treatment. Alternatively, the energy treatment may be plasma treatment.

The inner zone 24 of higher energy treatment extends the length of the flexible carrier 20. The outer zones 24 of lower energy treatment also extend the length of the carrier. The inner zone 24 is wide enough so that every container holder 22 has a portion 21 with higher energy treatment and friction, and a portion 23 with lower energy treatment and friction, for direct contact with a container. The inner zone 24 may encompass about 10–90%, suitably about 20–80% of the width of the flexible carrier 20.

The primary openings 25 may have a diameter or maximum dimension of 0.20 inch or greater, large enough that the container holders 22 can be stretched without tearing to accommodate containers. Secondary openings 29 can also be provided between the primary openings, to serve as gripping portions for the flexible carrier 20.

The containers to be inserted in the primary openings 25 may be bottles or cans having varying shapes and diameters. Referring to FIG. 1, for instance, each flexible carrier 20 is installed on containers by stretching the container holders 22 in the cross direction, in opposing fashion, as indicated by arrows 30. The carrier holders are installed around the containers while stretched, and are allowed to retract (recover) to provide a snug fit around the rib, chime or outside surface of the containers. The plan view dimensions of the flexible carrier 20, and its components, vary according to the end use. Particular end uses include without limitation beverage cans and bottles of various sizes and shapes.

Figure 7:
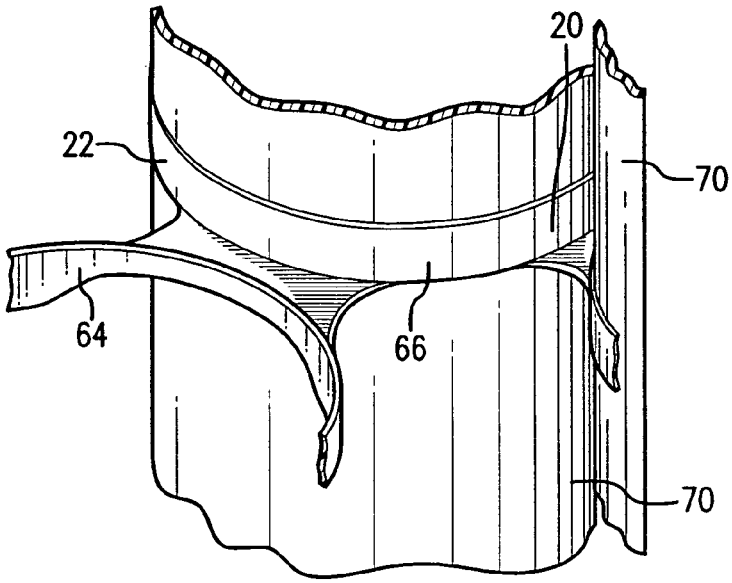
FIG. 7 illustrates a flexible carrier of the invention, in contact with a plurality of containers.

It is desired to selectively energy treat the flexible carrier 20 on only one side, which is the side that contacts the containers. Referring to FIG. 7, when the flexible carrier 20 is installed on a plurality of containers 70, the container holders 22 bend and curl so that an inner surface 64 of each holder 22 faces the container 70 and an outer surface 66 of each holder 22 faces away from the container 70. Suitably, only the side of the flexible carrier which encompasses the inner surface 64 of each holder is selectively energy treated. A processing advantage results when the selective energy treatment is applied to only one surface of a precursor film, which is then cut to form the flexible carrier 20. By applying the cutting mechanism to the side of the film which has not been energy treated, excess friction between the cutting mechanism and the film can be avoided. However, it is also within the scope of this invention to selectively energy treat both sides of the flexible carrier 20, or a precursor film from which the carrier is formed.

The flexible carrier 20 is desirably formed from a plastic film, which can be formed by an extrusion process and then cut to form the flexible carrier. The flexible carrier 20 has a thickness which provides sufficient structural integrity to carry a desired number of containers. For instance, each flexible carrier 20 may have enough container holders 22 to carry two, four, six, eight, ten or twelve containers of a desired product having a specific weight, volume, shape and size, and may have a corresponding number of container-receiving portions. For most applications, the flexible carrier 20 may have a thickness of about 3–50 mils, suitably about 5–30 mils, commonly about 10–20 mils.

The plastic film used to form the flexible carrier 20 is formed using a polymer composition which includes a polyolefin, such as polyethylene. Desirably, the polyolefin is a high pressure low density polyethylene. This polymer is desirably branched, and is prepared using a conventional high pressure polymerization process. The low density polyethylene polymer may be prepared using a Ziegler-Natta catalyst or a single-site catalyst system. The low density polyethylene polymer may be a homopolymer, or a copolymer of ethylene with one or more $C_3$ to $C_{12}$ alpha-olefin comonomers and/or carbon monoxide. Desirably, the low density polyethylene polymer includes a carbon monoxide comonomer, which makes the carrier more prone to degradation in the presence of ultraviolet light.

The desired amount of carbon monoxide comonomer in the low density polyethylene polymer varies depending on the percentage of the low density polyethylene polymer in the polymer blend composition. When present, the carbon monoxide comonomer may constitute about 0.1–20% by weight of the low density polyethylene polymer, suitably about 0.5–10% by weight, desirably about 1–4% by weight.

The low density polyethylene polymer should have a density of about 0.910–0.950, grams/cm$^3$, suitably about 0.920–0.940 grams/cm$^3$, desirably about 0.925–0.935 grams/cm$^3$. In other words, the term "low density polyethylene polymer" includes polyethylene polymers commonly considered as having medium density, as well as polyethylene polymers commonly considered as having low density. The low density polyethylene polymer should have a melt index of about 0.2–3.0 grams/10 min., suitably about 0.3–1.5 grams/10 min., desirably about 0.4–0.7 grams/10 min., measured at 190° C. using ASTM D1238.

The low density polyethylene polymer may constitute substantially the entire polymer composition, or may be combined with one or more additional polymers. In one embodiment, the polymer composition also includes about 1–50% by weight of an ethylene-alpha olefin copolymer plastomer having a density of about 0.850–0.905 grams/cm$^3$, and prepared using a single-site catalyst. Suitably, the plastomer has a density of about 0.865–0.895 grams/cm$^3$, desirably about 0.880–0.890 grams/cm$^3$. The alpha-olefin comonomer may have 3–12 carbon atoms, desirably 4–8 carbon atoms. The amount of the comonomer is whatever is required to achieve the desired plastomer density. Generally, the ethylene-alpha olefin copolymer plastomer includes about 5–30% by weight of the comonomer, suitably about 10–25% by weight. Suitably, the polymer blend includes about 3–30% by weight of the plastomer, desirably about 5–20% by weight of the plastomer.

The single-site catalyzed ethylene-alpha olefin copolymer plastomer may have a melt index of about 0.3–10 grams/10 min., suitably about 0.5–5 grams/10 min., desirably about 0.8–1.3 grams/10 min., measured at 190° C. using ASTM D1238. Suitable single-site catalyzed ethylene-alpha olefin copolymer plastomers are available from Exxon-Mobil Chemical Co. under the trade name EXACT, and from Dow Chemical Co. under the trade names AFFINITY and ENGAGE. Examples of suitable plastomers are described in U.S. Pat. No. 5,538,790, issued to Arvedson et al., and in U.S. Pat. No. 5,789,029, issued to Ramsey et al., the disclosures of which are incorporated by reference. The plastomer enhances the tear resistance of the carrier when it is notched or scratched, the elongation at break, and the recovery after stretch, as measured using the stress-strain test in ASTM D882-91.

The ethylene-carbon monoxide copolymer which destabilizes the carrier in the presence of ultraviolet radiation may be provided separately, in the form of a masterbatch or concentrate having a higher carbon monoxide content, or some or all of the carbon monoxide may be copolymerized with the low density polyethylene and/or the single-site catalyzed ethylene alpha olefin plastomer. Regardless of how the carbon monoxide is introduced and affiliated, the polymer blend should have a carbon monoxide content of about 0.1–10% by weight, suitably about 0.5–5% by weight, desirably about 1–2% by weight. Other polymers may also be added in amounts which substantially maintain or enhance the recovery, elongation, tensile strength, and tear resistance of the flexible carrier, and/or which provide the carrier with cold temperature resistance, stress crack resistance, enhanced clarity and other desirable properties. The polymer components may be dry blended and/or melt blended together. Typically, they are fed separately to the extruder which forms the flexible carrier sheet, and are melt blended in the extruder.

The polymer composition may also contain one or more slip agents. Slip agents are used to prevent excessive friction between the flexible carrier 20 and the containers, excessive friction between the flexible carrier 20 and equipment used to install the carrier around the containers, and excessive friction during manufacture of the carrier from the precursor film. Suitable slip agents include long chain fatty acids having about 18–21 carbon atoms and polar (e.g., amide) end groups. The polar end groups cause the slip agents to migrate toward the surfaces of the flexible carrier 20. Suitable slip agents include erucamide (having 21 carbon atoms with an amide end group) and oleamide (having 18 carbon atoms with an amide end group). The slip agent can be added in an amount up to 1000 ppm, and is suitably added at about 400–600 ppm.

As explained above, the flexible carrier 20 of the embodiment shown in FIG. 1 includes an inner zone 24 having higher energy treatment and two outer zones 26 having lower energy treatment generally separated by boundary lines 27. The zones 26 of lower energy treatment preferably experience no energy treatment. The zone 24 exhibits higher carrier-to-container friction than the zones 26, due to the selective energy treatment. The selective energy treatment is desirably a selective corona treatment. The selective corona treatment of zone 24 causes each container holder 22 to have a portion 21 of lower surface oxidation and a portion 23 of higher surface oxidation (caused by the corona treatment). Portion 21 has lower carrier-to-container friction and portion 23 has higher carrier-to-container friction.

The selective corona treatment can be effected by passing the flexible carrier 20 or precursor film between an electrode and a stainless steel plate in a corona treating station. The electrode may have a width which corresponds to the width of the zone 24, so that only the zone 24 of the carrier receives the treatment. The flexible carrier 20 or film may travel in a lengthwise direction through the corona treating station. The amount of corona treatment received by the zone 24 is determined by the length of the electrode, the traveling speed of the flexible carrier or film between the electrode and the plate, and the amount of electric potential generated between the electrode and plate.

Figure 5:
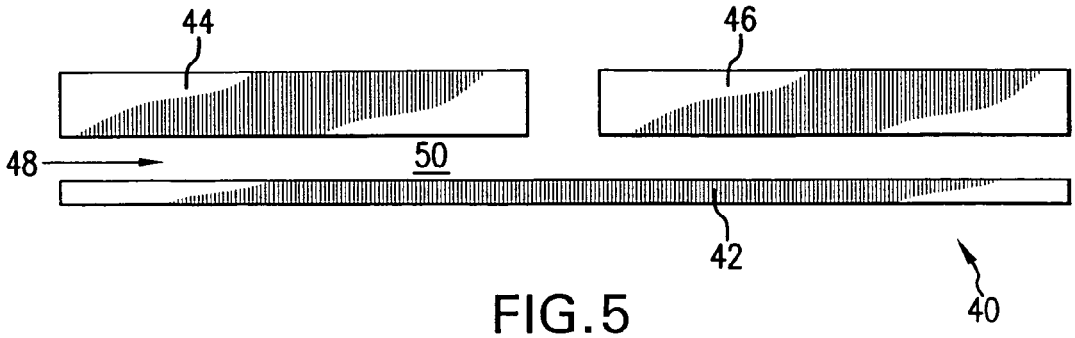
FIG. 5 schematically illustrates a corona treatment device for selectively treating only a portion of a flexible carrier or precursor film.

FIG. 5 schematically illustrates a corona treatment device 40. Two electrodes 44 and 46, arranged in series, may each have a length of about 6 inches and a width (perpendicular to the page) of about 2.5 inches. Alternatively, a higher number of electrodes can be arranged in series, or one long electrode can be used. A steel plate 42 is below the electrodes, defining an air space 50 between the electrodes and the plate. A flexible carrier 20, or a film from which a flexible carrier 20 is cut, passes between the plate and electrodes in a direction of arrow 48. If each electrode 44 and 46 is six inches long, the flexible carrier 20 or film is exposed to a corona treatment length of 12 inches.

In order for the corona treatment to impart a durable surface oxidation to the zone 24, which does not disappear over time, it is desired to treat the zone 24 with a very high watt density. The watt density may range from about 20–200 watts/ft$^2$/min., and is suitably about 30–150 watts/ft$^2$/min., particularly about 40–100 watts/ft$^2$/min. It has been found that the high watt density causes the zone 24 to maintain its surface oxidation for one year or more. The consequent benefit of improved container-to-carrier friction is similarly maintained for a long time period.

Using the corona treatment device 40 described above, the desired watt density in zone 24 of a 15-mil thick flexible carrier or film can be obtained using an air gap of 50–200 mils, suitably 60–150 mils, between the steel plate 42 and the electrodes 44 and 46. The zone 24 of the flexible carrier or film is passed between the plate and electrodes at a speed of up to about 250 ft/min., resulting in a corona treatment residence time of at least about 0.30 seconds. To achieve the desired watt density of 40–100 watts/ft$^2$/min. under these conditions, the corona treatment device 40 should operate using an electric power of 1.5–1.8 kilowatts. This amount of power creates an electric potential which converts the air in the gap 50 to disassociated oxygen and nitrogen atoms, some of which react with the surface of the flexible carrier or film.

It has been found that the selective corona treatment of the zone 24 provides the best improvement in flexible carrier to container friction if there is a waiting period between the manufacture of the film used to make the carrier strip, and the time of corona treatment. In other words, it is desirable to permit any slip additive to reach the film surface before exposing the surface to corona treatment. If the corona treatment occurs too soon after the film is manufactured, before the slip additive reaches the surface, then the slip additive will subsequently migrate to the surface and will not be affected by the corona treatment. The waiting period subsequent to film manufacture until corona treatment should be about three days or more, suitably about seven days or more, particularly about ten days or more.

Alternatively, the selective energy treatment of zone 24 may be a selective plasma treatment. Plasma treatment equipment is known in the art, and has previously been used for treating plastic fabrics, to enhance penetration and adhesion of reinforcing fibers used in the fabrics. Plasma treatments have also been used to enhance the metallization of films that are coated via metallization processes.

In a typical plasma treating process, plasma is created by supplying energy in the form of radio frequency electromagnetic radiation to ionize a process gas which can be oxygen, nitrogen, argon, helium, or combinations thereof, for example. The plasma includes electrons, ions, and other energetic metastable species. The energies of individual plasma particles may range from about 3–20 electron volts. When these energetic particles contact a surface in zone 24 of flexible carrier 20, the surface becomes energized via ionization or chemical reaction (typically oxidation).

At present, plasma treatment is more expensive than corona treatment. Thus, it is contemplated that corona treatment is the most desirable method of achieving selective energy treatment of zone 24 of flexible carrier 20. Plasma treatment is available as an alternative or equivalent way of achieving the same result, which is a selectively higher coefficient of friction in zone 24. The plasma treatment technique can be optimized by persons skilled in the art, to achieve the desired coefficient of friction in zone 24 at suitable line speed and power.

Figure 6:
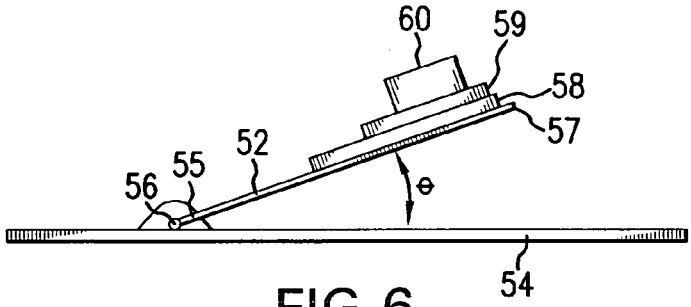
FIG. 6 schematically illustrates a device for measuring carrier-to-container friction.

The coefficient of friction in the zone 24 resulting from corona or plasma treatment should be about 0.25–1.0, suitably about 0.30–0.50, particularly about 0.35–0.45, measured using an inclined plane technique illustrated in FIG. 6. Referring to FIG. 6, a flat support plate 52 is mounted at one end 55 to a horizontal base 54 using a pivot mount 56. A sheet 58, made of the same material (e.g., aluminum) as the containers of interest, or a coating layer on the containers, is placed near the opposite end 57 of plate 52. A film 59 of flexible carrier material, having a length of at least 3 inches and a width of at least one inch, is placed above sheet 58 near the opposite end 57 of the plate 52. A sled 60 having a mass of 567 grams and lower surface dimensions of 3 inches×1 inch, is placed over a 3 $in^2$ area of the film 59, with the long (3-inch) dimension of the sled 60 being parallel to the incline of the support plate 52.

The end 57 of support plate 52 is gradually lifted, causing an increase in the incline and an increase in the angle θ between the support plate 52 and the base 54. When the plate 52 reaches a sufficient incline, the film 59 of flexible carrier material will begin to slide along the surface of the sheet 58 due to the gravitational force acting on sled 60. At that point, the angle θ is measured, and the coefficient of friction μ is determined from the following equation:

$$\mu = \tan \theta$$

Figure 2:
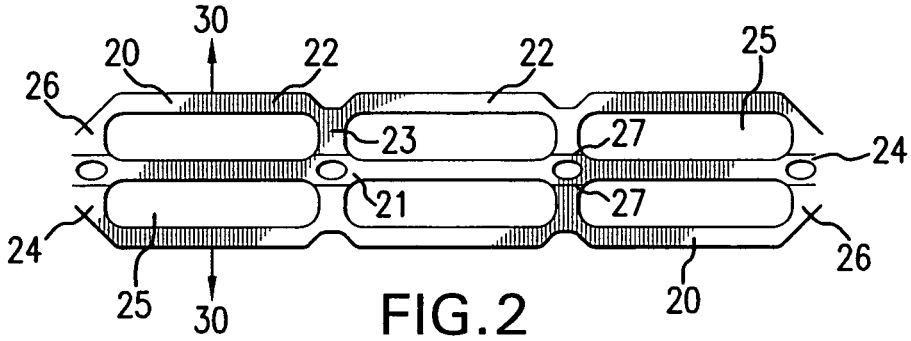
FIG. 2 illustrates another flexible carrier of the invention, having a zone of higher energy treatment and two zones of lower energy treatment.
Figure 3:
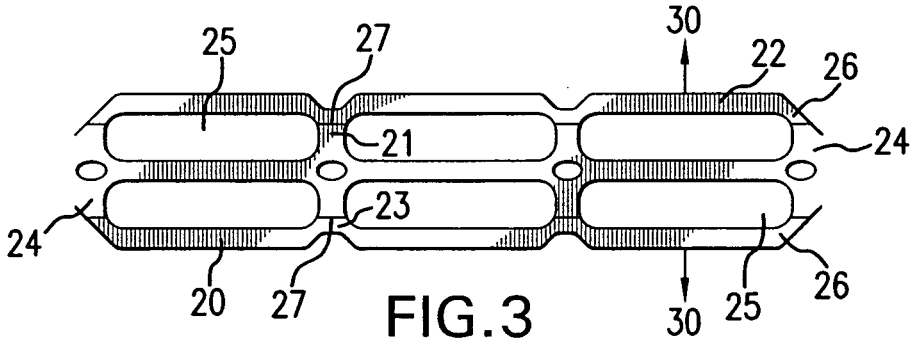
FIG. 3 illustrates a flexible carrier similar to the one shown in FIG. 2, with an enlarged zone of higher energy treatment.
Figure 4:
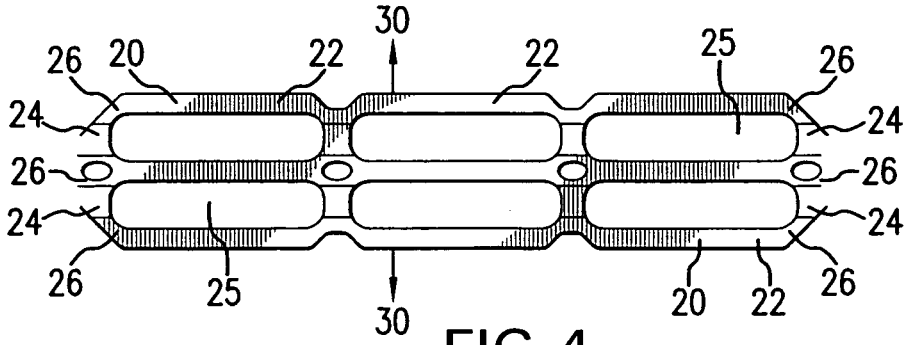
FIG. 4 illustrates a flexible carrier similar to the one shown in FIG. 2, with two zones of higher energy treatment and three zones of lower energy treatment.

FIGS. 2–4 illustrate alternative embodiments of flexible carriers 20 of the invention in which the same elements are numbered the same way as in FIG. 1. FIG. 2 illustrates a flexible carrier 20 of the invention having narrower container holders 22 and primary openings 25. The inner zone 24 of higher corona or plasma treatment is also relatively narrow, and includes only one side of each rectangular-shaped container holder 22. The outer zones 26 of lower corona or plasma treatment encompass three sides of each rectangular-shaped container holder 22. The flexible carrier 20 of FIG. 2 does not have secondary openings which serve as gripping portions. Again, the carrier 20 is installed on containers by stretching the container holders 22 in the cross direction, in opposing fashion, as indicated by arrows 30.

FIG. 3 illustrates an alternative embodiment of a flexible carrier 20 of the invention, similar to the one shown in FIG. 2, except that the inner zone 24 of higher corona or plasma treatment is much wider. In the flexible carrier 20 of FIG. 3, the inner zone 24 of higher corona or plasma treatment encompasses three sides of each rectangular-shaped container holder 22. The outer zones 26 of lower corona or plasma treatment encompass only one side of each container holder 22. The flexible carrier 20 of FIG. 3 is useful for more slippery and/or heavier containers which benefit from greater overall friction with the flexible carrier. The zones 26 of lower corona or plasma treatment and friction are large enough to avoid excessive friction between the carrier 20 and the gripping jaws of equipment used to stretch and install the carrier 20 on the containers.

FIG. 4 illustrates an alternative embodiment of a flexible carrier 20 of the invention, similar to the one shown in FIGS. 2 and 3, except that there are two inner zones 24 of higher corona or plasma treatment, and one inner and two outer zones 26 of lower corona or plasma treatment. The zones 24 of higher corona or plasma treatment encompass the two short sides of each rectangular-shaped container holder 22. The zones 26 of lower corona or plasma treatment encompass the two long sides of each rectangular-shaped container holder 22.

In each of the embodiments of FIGS. 1–4, the zones 24 of higher energy treatment can be formed using a selectively applied corona treatment process as described above, or a selectively applied plasma treatment process. The zones 26 of lower energy treatment can be exposed to less or no corona or plasma treatment.

EXAMPLES

In the following examples, corona-treated sheet samples useful to make flexible carriers resembling those shown in FIG. 3 were selectively energy treated along an inner zone. Each flexible carrier sheet was formed from an ethylene-carbon monoxide copolymer having a density of 0.927 grams/$cm^3$, a melt index of 0.5 grams/10 min., and a carbon monoxide comonomer content of 0.75% by weight. The ethylene-carbon monoxide comonomer was combined with 500 ppm oleamide slip.

In Example 1, five samples were prepared with no corona treatment and five samples were corona treated using a power of 1.6 kw, a line speed of 80 ft/min., and a residence time of 0.75 sec., to produce a watt density of 96 watts/$ft^2$/min., using a corona treatment apparatus resembling the one shown in FIG. 5. The corona treatment apparatus was manufactured by Corona Designs Corp. under the trade name POWERHOUSE. The corona treated carrier sheets were corona treated several days after preparation, to allow sufficient migration of slip additive(s) prior to corona treatment.

The carrier sheets were evaluated for friction approximately one year later, using flat beverage can material having a "matte" finished surface made of a REXAM proprietary coated aluminum. Friction was measured using an incline coefficient-of-friction tester as described with respect to FIG. 6. As shown in Table 1 (below), the corona-treated carrier sheet samples had an average coefficient of friction about twice as high as the untreated samples, after one year.

TABLE 1

(Example 1)

| COF For Corona-Treated Samples | | COF For Untreated Samples | |
|---|---|---|---|
| A | 0.554 | A | 0.259 |
| B | 0.488 | B | 0.287 |
| C | 0.532 | C | 0.259 |
| D | 0.577 | D | 0.240 |
| E | 0.649 | E | 0.315 |
| Average | 0.560 | Average | 0.272 |
| St. Dev. | 0.06 | St. Dev. | 0.03 |

In Example 2, five carrier sheet samples with no corona treatment and five carrier sheet samples with corona treatment were prepared in the same manner described for Example 1. In this instance, the carrier sheets were evaluated for friction approximately two years later, using the same can material and techniques. As shown in Table 2, the corona treated samples had a coefficient of friction more than twice as high as the untreated samples, even after two years.

TABLE 2

(Example 2)

| COF For Corona-Treated Samples | | COF For Untreated Samples | |
|---|---|---|---|
| A | 0.601 | A | 0.268 |
| B | 0.649 | B | 0.287 |
| C | 0.839 | C | 0.240 |
| D | 0.674 | D | 0.249 |

TABLE 2-continued

| (Example 2) | | | |
|---|---|---|---|
| COF For Corona-Treated Samples | | COF For Untreated Samples | |
| E | 0.687 | E | 0.277 |
| Average | 0.690 | Average | 0.264 |
| St. Dev. | 0.09 | St. Dev. | 0.02 |

Example 3 was performed using a plasma treater available from Plasmatreat Corp. under the trade name FLUME. A narrow strip 0.75 in. wide was selectively plasma treated. The plasma treater was set at full power of about 0.25 kw. Sheet samples were selectively treated at 20, 40, 60 and 80 feet/min. yielding treatment residence times of 0.25 sec., 0.125 sec., 0.083 sec. and 0.0625 sec., respectively. Selective plasma treatment resulted at all speeds, although the treatment was heavier at lower speeds. These samples have not been further evaluated.

While the embodiments of the invention described herein are presently preferred, various modifications and improvements can be made without departing from the spirit and scope of the invention. The scope of the invention is indicated by the appended claims and all changes that fall within the meaning and range of equivalents are intended to be embraced therein.

We claim:

1. A flexible carrier for carrying a plurality of containers, comprising:

a flexible sheet; and a plurality of container holders formed in the sheet, each defining a primary opening for receiving a container;

each container holder having a portion with higher energy treatment and a portion with lower energy treatment extending a length of the container holder;

wherein the energy treatment is selected from the group consisting of corona treatment, plasma treatment, and combinations thereof and the higher energy treatment has a watt density of at least about 20 watts/ft$^2$/min.

2. The flexible carrier of claim 1, further comprising a selectively energy treated zone encompassing the portions of the container holders with higher energy treatment.

3. The flexible carrier of claim 2, wherein the selectively energy treated zone extends a length of the carrier.

4. The flexible carrier of claim 2, further comprising one or more zones of no energy treatment encompassing the portions of the container holders with lower energy treatment.

5. The flexible carrier of claim 1, wherein the portions of the container holders with higher energy treatment have a corona treatment of at least about 20 watts/ft$^2$/min.

6. The flexible carrier of claim 1, wherein the portions of the container holders with higher energy treatment have a corona treatment of at least about 40 watts/ft$^2$/min.

7. The flexible carrier of claim 1, comprising 2–12 of the container holders.

8. The flexible carrier of claim 1, further comprising one or more secondary openings which serve as gripping portions.

9. A flexible carrier for carrying a plurality of containers, comprising:

a flexible sheet formed of a polyolefin composition;

a plurality of container holders formed in the sheet, each defining a primary opening for receiving a container;

each container holder having a portion with higher energy treatment and a portion with lower energy treatment; and at least one selectively energy treated zone encompassing the portions with higher energy treatment;

wherein the energy treatment is selected from the group consisting of corona treatment, plasma treatment, and combinations thereof and the selectively energy treated zone has a watt density of at least about 20 watts/ft$^2$/min.

10. The flexible carrier of claim 9, wherein the energy treatment comprises corona treatment and the selectively energy treated zone is a selectively corona treated zone.

11. The flexible carrier of claim 10, wherein the selectively corona treated zone has a corona treatment of about 20–250 watts/ft$^2$/min.

12. The flexible carrier of claim 10, wherein the selectively corona treated zone has a corona treatment of about 30–150 watts/ft$^2$/min.

13. The flexible carrier of claim 10, wherein the selectively corona treated zone has a corona treatment of about 40–100 watts/ft$^2$/min.

14. The flexible carrier of claim 9, wherein the energy treatment comprises plasma treatment and the selectively energy treated zone comprises a selectively plasma treated zone.

15. The flexible carrier of claim 9, wherein the polyolefin composition comprises a high pressure low density polyethylene polymer.

16. The flexible carrier of claim 15, wherein the low density polyethylene polymer comprises an ethylene-carbon monoxide copolymer.

17. The flexible carrier of claim 15, wherein the polyolefin composition further comprises a single-site catalyzed ethylene-alpha olefin copolymer plastomer.

18. The flexible carrier of claim 9, wherein the polyolefin composition further comprises a slip additive.

19. The flexible carrier of claim 18, wherein the slip additive comprises erucamide.

20. The flexible carrier of claim 18, wherein the slip additive comprises oleamide.

21. A flexible carrier for carrying a plurality of containers, comprising:

a flexible sheet formed of a polymer composition;

a plurality of container holders formed in the sheet, each defining a primary opening for receiving a container;

at least one selectively energy treated zone encompassing a portion of each container holder and having a watt density of at least about 20 watts/ft$^2$/min; and at least one zone of no energy treatment encompassing another portion of each container holder.

22. The flexible carrier of claim 21, wherein the selectively energy treated zone comprises a selectively corona treated zone.

23. The flexible carrier of claim 22, wherein the selectively corona treated zone has a corona treatment of at least about 20 watts/ft$^2$/min.

24. The flexible carrier of claim 22, wherein the selectively corona treated zone has a corona treatment of at least about 30 watts/ft$^2$/min.

25. The flexible carrier of claim 22, wherein the selectively corona treated zone has a corona treatment of at least about 40 watts/ft$^2$/min.

26. The flexible carrier of claim 21, wherein the selectively energy treated zone comprises a selectively plasma treated zone.

27. The flexible container of claim 21, wherein the polymer composition comprises an ethylene polymer and a slip additive.

* * * * *